US010314333B2

(12) United States Patent
Han

(10) Patent No.: US 10,314,333 B2
(45) **Date of Patent: *Jun. 11, 2019**

(54) SMOKING DEVICE

(71) Applicant: Tyger Manufacturing LLC, Walnut, CA (US)

(72) Inventor: Jeffrey Han, Los Altos Hills, CA (US)

(73) Assignee: Tyger Manufacturing LLC, Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,387

(22) Filed: May 14, 2018

(65) Prior Publication Data

US 2019/0000138 A1 Jan. 3, 2019

Related U.S. Application Data

(63) Continuation of application No. 14/625,013, filed on Feb. 18, 2015, now Pat. No. 9,968,127.

(51) Int. Cl.
*A24F 1/28* (2006.01)
*A24F 1/32* (2006.01)
(Continued)

(52) U.S. Cl.
CPC ..... *A24F 1/28* (2013.01); *A24F 1/32* (2013.01); *A24F 7/00* (2013.01); *A24F 47/002* (2013.01)

(58) Field of Classification Search
CPC ..... A24F 47/008; A24F 47/00; A24F 1/28; A24F 1/32; A24F 1/26; A24F 7/00;
(Continued)

(56) References Cited

U.S. PATENT DOCUMENTS 136,487 A * 3/1873 Buynitzky ..... A24F 1/00 131/180
2,402,914 A * 6/1946 Robertson ..... A24F 1/26 131/180

(Continued)

FOREIGN PATENT DOCUMENTS

| | | |
|---|---|---|
| CN | 203841101 U | 9/2014 |
| GB | 24730 | 10/1925 |
| GB | 715507 | 9/1954 |

OTHER PUBLICATIONS

Ravenstine, "Where can I find a very small auger?", date unknown, https://www.instructables.com/topics/Where-can-l-find-a-very-small-auger/, Instructables, US.

(Continued)

*Primary Examiner* — Seyed Masoud Malekzadeh
*Assistant Examiner* — Taryn Trace Willett

(57) ABSTRACT

The present invention is a smoking device comprising a glass housing having lower and upper open end portions and an inner portion. The smoking device further comprises a body rotatably and sealably engaged with the lower open end portion of the glass housing by at least one o-ring. The smoking device further comprises an auger comprising a first end portion engaged with the body and a second end portion extending within the inner portion of the glass housing to form a bowl area. Rotation of the body causes the auger to rotate and the smoking material to be moved upward thru the inner portion of the glass housing to the bowl area where it is ignited by a match, lighter or other heat source.

18 Claims, 5 Drawing Sheets

(51) Int. Cl.
*A24F 7/00* (2006.01)
*A24F 47/00* (2006.01)

(58) Field of Classification Search
CPC .. A24F 7/02; A24F 13/10; A24F 13/16; A24F 13/20
See application file for complete search history.

(56) References Cited

U.S. PATENT DOCUMENTS 2,533,956 A * 12/1950 Robertson ..... A24F 1/00 131/180
4,171,000 A 10/1979 Uhle
4,286,416 A * 9/1981 Cooper, Jr. ..... B28D 1/181 15/104.095
D267,886 S 2/1983 Albertini
5,687,746 A * 11/1997 Rose ..... A24F 47/002 128/202.21
6,196,232 B1 3/2001 Chkadua
6,260,554 B1 7/2001 Rowland
D687,181 S 7/2013 Goch
D709,751 S 7/2014 Wu
8,925,714 B1 1/2015 Buser
D739,979 S 9/2015 Smith
2005/0016553 A1* 1/2005 Iannuzzi ..... A24F 47/002 131/273
2007/0267032 A1* 11/2007 Shan ..... A24F 47/002 131/275
2010/0078035 A1* 4/2010 Erickson ..... A24F 1/28 131/191
2013/0269716 A1 10/2013 Hoang
2015/0013704 A1* 1/2015 Maglione ..... A24F 5/00 131/330
2015/0020822 A1* 1/2015 Janardhan ..... A24F 47/008 131/328
2015/0122277 A1* 5/2015 Frobisher ..... A24D 3/04 131/329
2015/0136124 A1* 5/2015 Aronie ..... A24F 47/008 128/202.21
2015/0144146 A1* 5/2015 Selby ..... A24F 1/28 131/328
2015/0223523 A1* 8/2015 McCullough ..... A61M 15/06 131/328
2016/0198769 A1* 7/2016 Liu ..... F22B 1/284 131/329
2017/0035105 A1* 2/2017 Jordan ..... A24F 9/16

OTHER PUBLICATIONS

Dimadima, "Archimedes Screw Pump", date unknown, http://dimdima.com/science/science _common/show _science. asp?q _aid=268&q _title=Archimedes+Screw+Pump, Dimadima, Country of Publication Unknown.
Grasscompany.Com, "The BudBomb", Nov. 6, 2008, https://www.youtube.com/watch?v=hAq9eVEUGcl, Grasscompany.Com, Country of Publication Unknown.

* cited by examiner

SMOKING DEVICE

CROSS-REFERENCE TO RELATED APPLICATIONS

This application claims the benefit of and priority to U.S. Utility patent application Ser. No. 14/625,013 filed on Feb. 18, 2015, now pending, which is hereby incorporated into this specification by reference in its entirety.

BACKGROUND OF THE INVENTION

The present invention relates to smoking devices such as pipes used by a person to smoke or consume a smoking material such as tobacco, medical marijuana, or the like. Various conventional smoking devices have been designed. Such conventional devices are not designed for optimum performance, comfort, versatility, ease of use, portability, and fabrication.

SUMMARY OF THE INVENTION

The present invention is a smoking device that may be used by a person to consume or smoke a smoking material such as tobacco, medical marijuana, or the like. The smoking device comprises a glass housing having lower and upper open end portions and an inner portion. The smoking device further comprises a body having a front body portion that acts like a mouthpiece, an intermediate body portion disposed outside of the glass housing, and a rear body portion rotatably and sealably engaged with the lower open end portion of the glass housing by at least one rubber o-ring. The body further comprises a plurality of air passage ways extending inward from a plurality of openings in the rear body portion. The smoking device further comprises an auger comprising a first end portion engaged with the rear body portion of the body and a second end portion extending within the inner portion of the glass housing to form a bowl area. Rotation of the body causes the auger to rotate and the smoking material to be moved upward thru the inner portion of the glass housing to the bowl area where it is ignited by a match, lighter or other heat source.

BRIEF DESCRIPTION OF THE DRAWINGS

The following description of the invention will be more fully understood with reference to the accompanying drawings in which.

DESCRIPTION OF THE INVENTION

Figure 1:
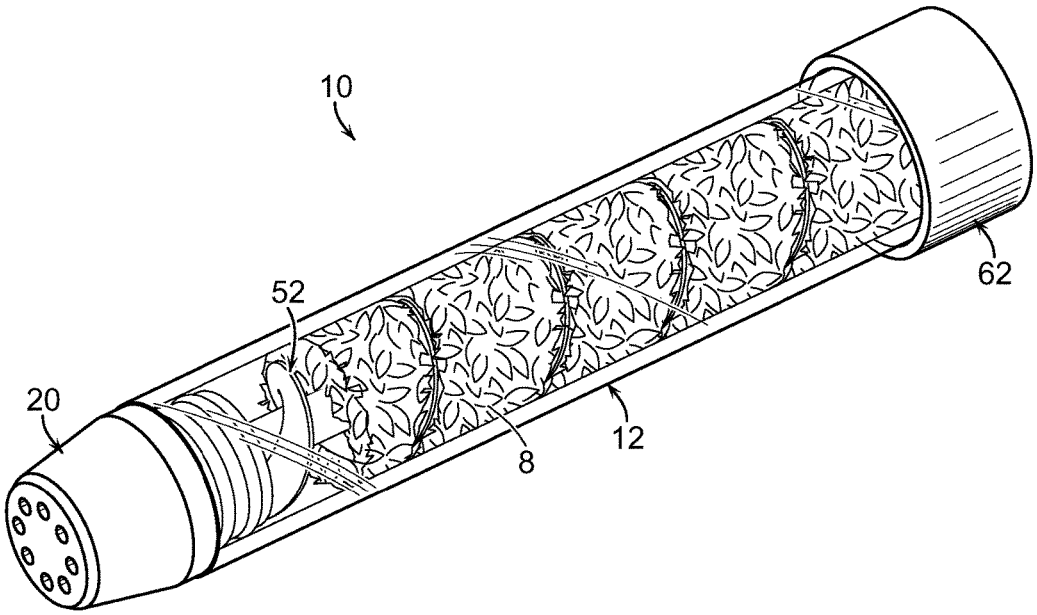
FIG. 1 is a front perspective view of a smoking device according the present invention.
Figures 2, 3:
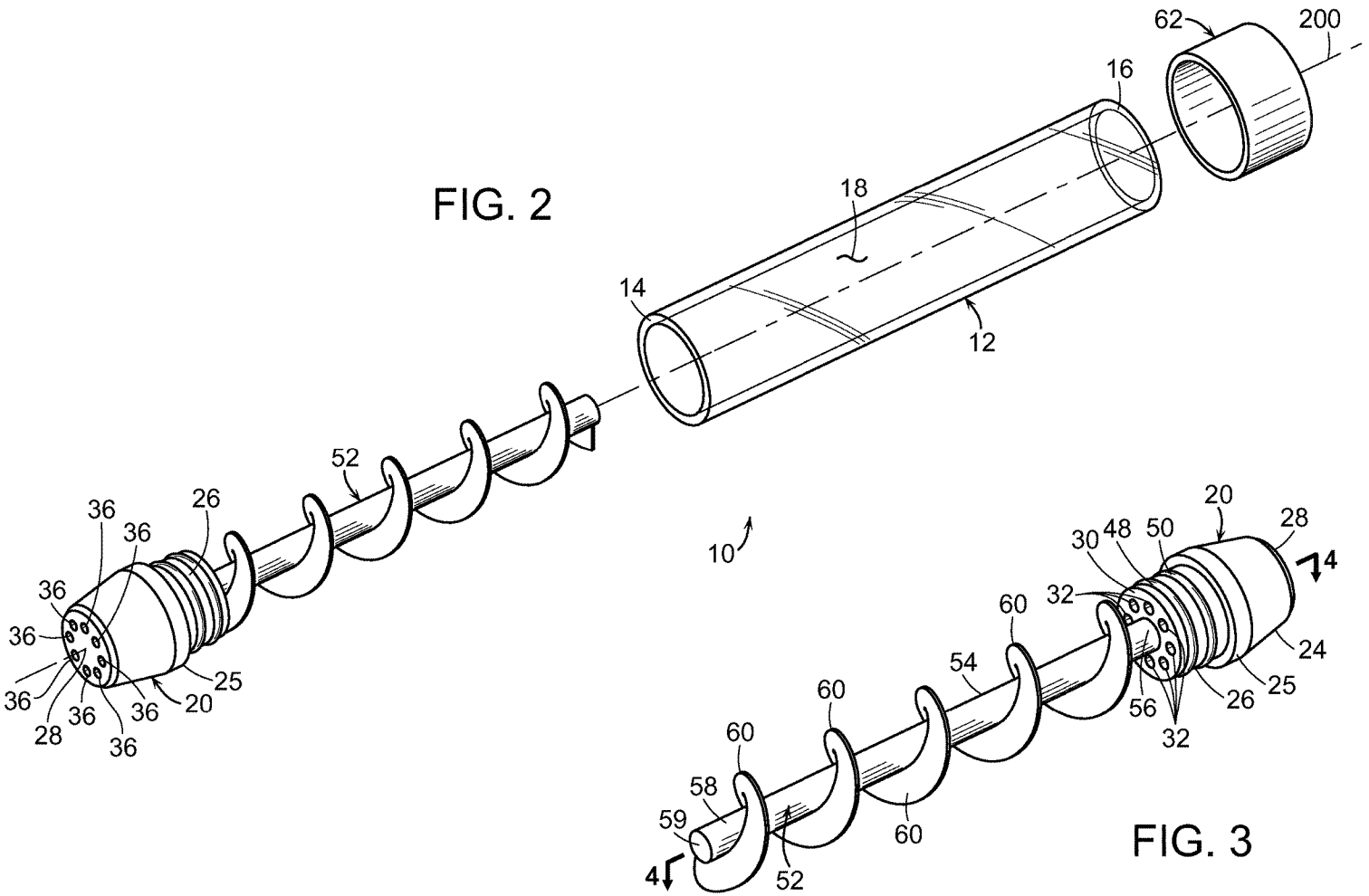
FIG. 2 is an exploded view of the smoking device.
FIG. 3 is rear perspective of a body and auger according to the present invention.
Figure 4:
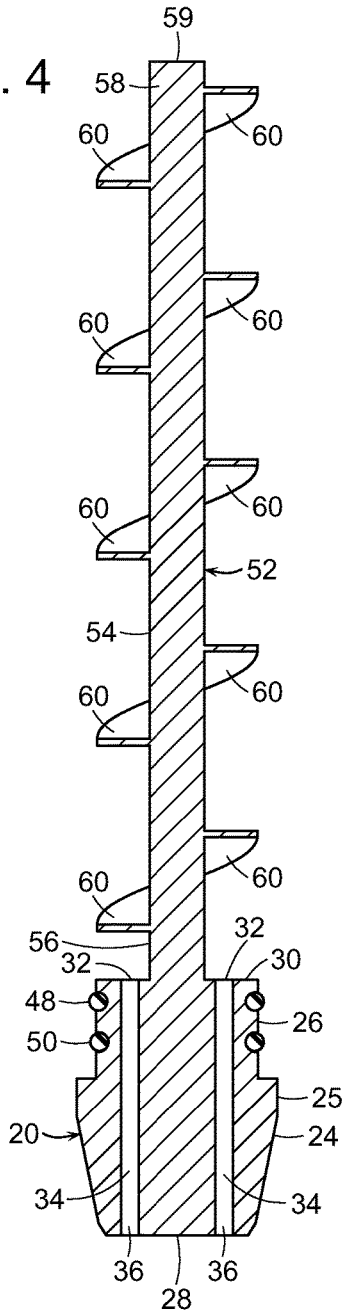
FIG. 4 is a cross-section view taken along line 3-3 of FIG. 3.

Referring to FIGS. 1 and 2, a smoking device 10 may be used by a person to smoke or consume a smoking material 8 such as tobacco, medical marijuana or the like. Smoking device 10 generally comprises a glass housing 12, a body 20 and an auger 52 engaged with or formed as part of body 20. As will be described more fully herein, rotation of body 20 causes auger 52 to rotate and smoking material 8 to move upward within housing 12 to a bowl area 100 (to be described) where it is ignited by a match, lighter or other heat source. Smoking device 10 provides an easier and more effective way of consuming smoking material 8 than conventional smoking devices.

Referring to FIG. 2, glass housing 12 comprises a lower open end portion 14, an upper open end portion 16, and an inner portion 18. Housing 12 is a cylindrical tube having a length of about 86 mm, a wall thickness of about 2 mm, and a inside diameter of about 13 mm. Housing 12 is made from boro silicate glass or any other material having good heat resistant properties. Housing 12 is fabricated by conventional processes.

Referring to FIGS. 2 and 3, body 20 comprises a body 22 having a front body portion 24 that acts as a mouthpiece and having a front surface 28, an intermediate body portion 25, and a rear body portion 26 having a rear surface 30. Rear body portion 26 is rotatably disposed within lower open end portion 14 of glass housing 12. Intermediate body portion 25 of body 20 abuts lower open end portion 14 of glass housing 12. Rear body portion 26 has a diameter of about 13 mm but should be slightly less than the inside diameter of lower open end portion 14 to permit rotation therein. Body 20 further comprises an o-ring 48 engaged with and retained by an annular channel (not shown) formed in rear body portion 26 of body 20 to provide sealed engagement between rear body portion 26 of body 20 and lower open end portion 14 of housing 12 during rotation of rear body portion 26 relative to lower open end portion 14 of housing 12. Body 20 further comprises an o-ring 50 engaged with and retained by an annular channel (not shown) of rear body portion 26 to provide sealed engagement between rear body portion 26 of body 20 and lower open end portion 14 of housing 12. O-ring 50 is provided in the event of failure of o-ring 48. The annular channels have a depth of about 1.78 mm. O-rings 48 and 50 are made from silicone rubber having an outside diameter of about 13 mm, and a thickness of about 1 mm. O-rings 48 and 50 are widely available. Different materials and hardness may be used so long as o-rings 48 and 50 allow and maintain rotatable sealed engagement between rear body portion 26 of body 20 and lower open end portion 14 of housing 12. Body 20 further comprises a plurality of openings 32 in rear surface 30 that lead to air passage ways 34 that terminate at openings 36 in front body portion 24 of body 20. Openings 32 and 36 are arranged in a circular pattern about front surface 28 and rear surface 30 of body 20. More or less than eight (8) air passage ways may be employed. Each of air passage ways 34 is shaped in the form of a cylinder having an inside diameter of about 1.5 mm. Any diameter significantly larger results in smoking material passing thru the air passage ways. Any diameter significantly smaller reduces air flow. In the embodiment shown, front body portion 24, intermediate body portion 25, and rear body portion 26 are integrally made from a single piece of material such as brass. Body 20 may be made from any other heat resistant material such as steel and fabricated by conventional processes.

Figure 8:
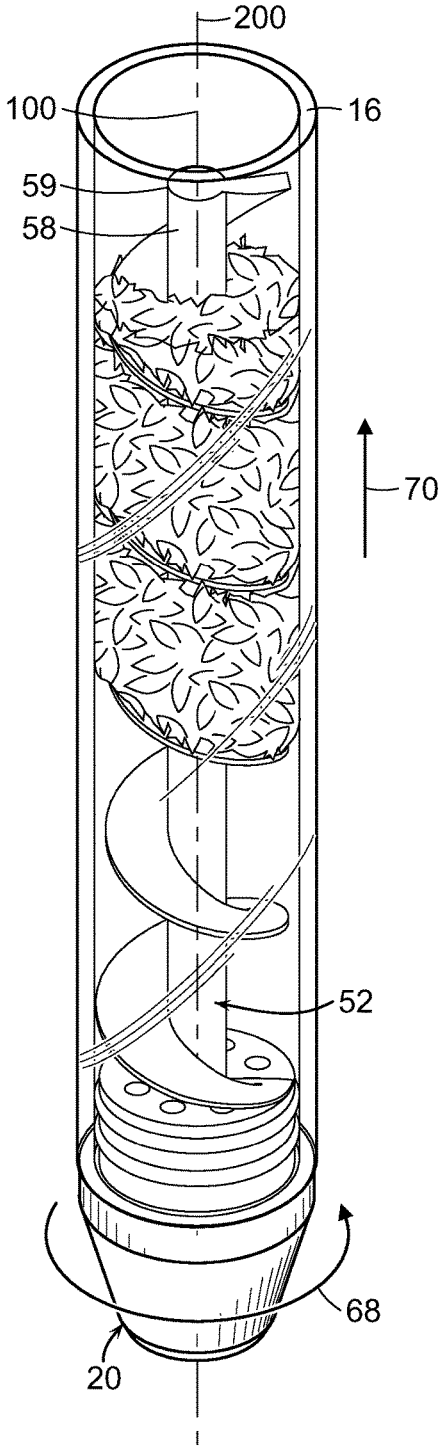
FIG. 8 is a perspective view of the smoking device after use and a number of clockwise rotations of the body and auger leaving a small amount of smoking material remaining.

With continued reference to FIG. 3, auger 52 comprises a shaft 54 having a first end portion 56 and a second end portion 58, and a helical blade 60. Auger 52 has a length of about 73 mm. Helical blade 60 has a diameter of about 13 mm and a pitch of about 17.3 mm. The diameter of helical blade 60 should be slightly less than the inside diameter of housing 12 to permit rotation therein. With reference to FIG. 8, when fully assembled, second end portion 58 of auger 52 is disposed about 6 mm inward from upper open end portion 16 of glass housing 12 leaving a cherry or burn area or bowl area 100 within and at said upper open end portion 16 of said glass housing 12. Bowl area 100 is bound by upper open end portion 16 of glass housing 12 and a terminal end surface 59 of second end portion 58 of auger 52 adjacent to and facing bowl area 100. Shaft 54 of auger 52, glass housing 12 extending from its lower open end portion 14 to upper open end portion 16, and bowl area 100 share a common central longitudinal axis 200. Rotation of body 20 causes rotation of auger 52 causing the smoking material within glass housing 12 to move toward to bowl area 100. Further rotation of body 20 causes auger 42 to expel the smoking material from upper open end portion 16 of glass housing 12. Auger 52 is press-fitted or otherwise engaged or secured to rear body portion 26 of body 20. Auger 52 is made from brass or any other heat resistant material such as steel and fabricated by conventional processes. Alternatively, body 20 and auger 52 may be made from a single piece of material.

Smoking device 10 further comprises a cap 62 (FIG. 2) removably engaged with upper open end portion 16 of glass housing 12. Cap 62 is made from plastic and fabricated by conventional processes. Cap 62 is provided so that housing 12 can be filled with smoking material 8 and to prevent loss of smoking material 8 during non use and/or transport of smoking device 10 thereby making smoking device 10 easily portable. Cap 62 may be made from a variety of materials such as silicone rubber and fabricated by conventional processes.

Figure 5:
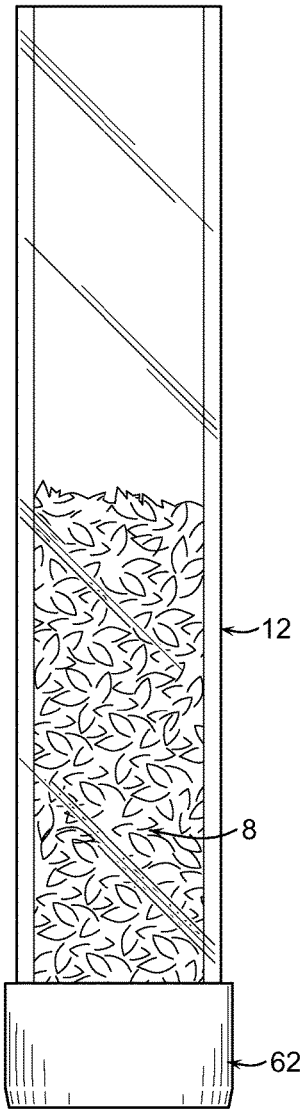
FIG. 5 is a view showing a housing of the smoking device filled with smoking material without insertion of the body and auger.
Figure 6:
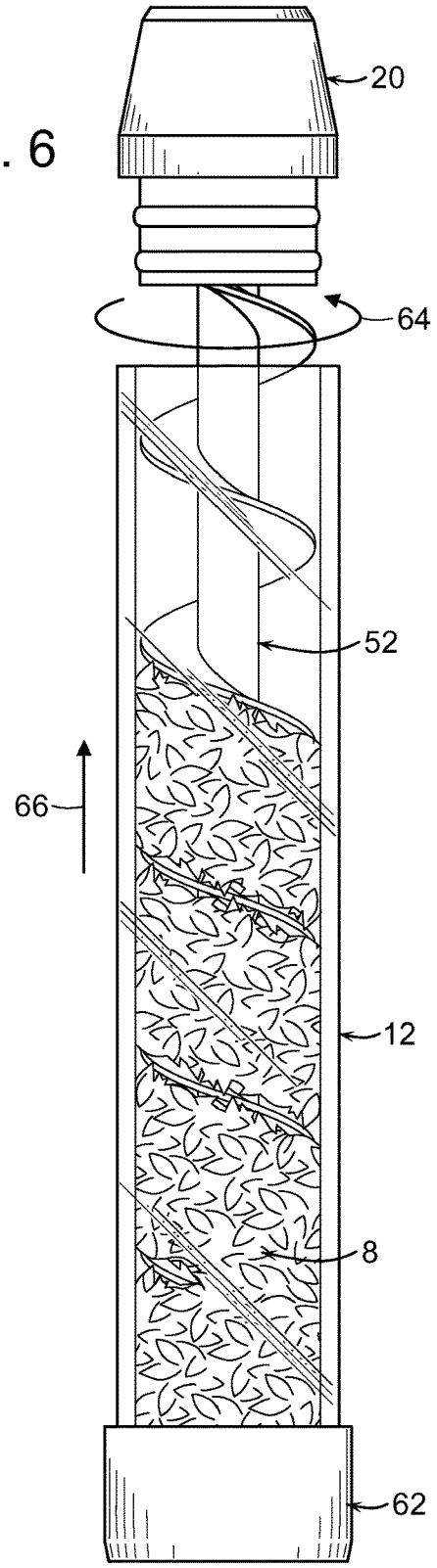
FIG. 6 is a view showing partial insertion of the body and auger within the housing by counter clockwise rotation of the body and auger causing movement of the smoking material around the helical blade of the auger.

Referring to FIGS. 5 and 6, where smoking device 10 is shown being filled with smoking material 8. As shown by FIG. 5, cap 62 is placed on upper open end portion 16 of housing 12. Housing 12 is flipped and disposed vertically so that cap 62 is resting upon a hard surface (not shown). Smoking material 8 is added thru lower open end portion 14 thereby filling upper open end portion 16 and inner portion 18. Housing 12 may be filled about half way with smoking material 8. As shown by FIG. 6, counter-clockwise rotation 64 of intermediate portion 23 of body 20 causes helical blade 60 of auger 52 to rotate and move smoking material 8 from upper open end portion 16 toward lower open end portion 14 of housing 12 as helical blade 54 moves inward to inner portion 18 of housing 12. Continued counter-clockwise rotation 64 of intermediate portion 25 of body 20 results in helical blade 60 being fully inserted within inner portion 18 of housing 12 with smoking material 8 surrounding most of helical blade 60 of auger 52. O-rings 48 and 50 provide sealed engagement.

Figure 7:
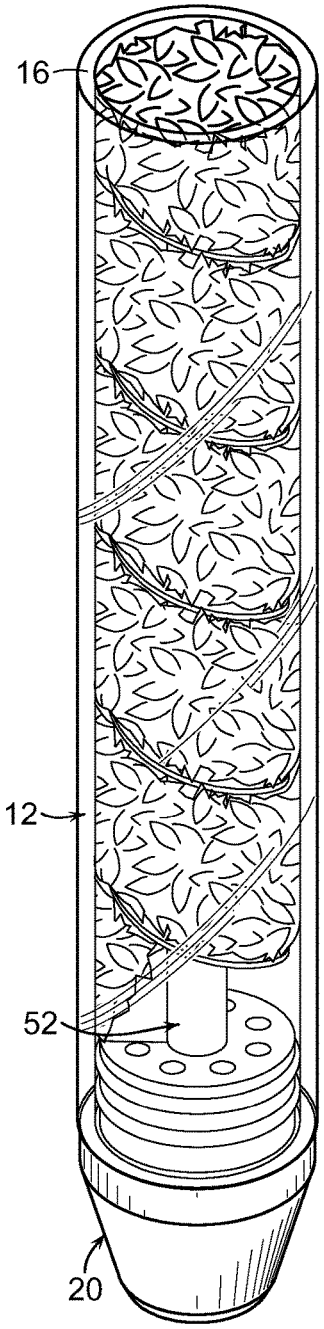
FIG. 7 is a perspective view of the smoking device filled with the smoking material and ready for use.

Referring to FIG. 7, where smoking device 10 is shown substantially filled with smoking material 8 with cap 60 removed.

Referring to FIG. 8, where smoking device 10 is shown after use and a number of clockwise rotations 68 of body 20. Clockwise rotation 68 of intermediate body portion 25 of body 20 causes helical blade 60 of auger 52 to rotate and move smoking material 8 from lower open end portion 14 and inner portion 18 toward upper open end portion 16 and bowl area 100. Repeated clockwise rotation 68 of intermediate body portion 25 of body 20 will cause substantially all of smoking material to be moved to bowl area 100 where it is ignited by a match, lighter, or other heat source. Glass housing 12 can easily be removed from body 20 to allow for filling of glass housing 12 by sliding lower open end portion 14 of glass housing 16 on and off first and second o-rings 48 and 50 that are mounted to rear body portion 26 of body 20.

The foregoing description is intended for purposes of illustration. The invention may be embodied in other forms or carried out in other ways without departing from the spirit or scope of the invention.

What is claimed:

1. A device for consuming a smoking material comprising:

a glass housing comprising a lower open end portion, an upper open end portion, and an inner portion;

a body comprising a rear body portion comprising a rear surface disposed within said lower open end portion of said glass housing;

a first rubber o-ring removably attached to said rear body portion; said rear body portion of said body being rotatably and sealably engaged with said lower open end portion of said glass housing by said first rubber o-ring; and an auger comprising a first end portion engaged with said rear body portion and a second end portion extending within said inner portion of said glass housing to form a bowl area at said upper open end portion of said glass housing; said bowl area being bound by said upper open end portion of said glass housing and a terminal end surface of said second end portion of said auger adjacent to and facing said bowl area; said auger, said glass housing extending from said lower open end portion to said upper open end portion, and said bowl area share a common central longitudinal axis; rotation of said body causes rotation of said auger causing the smoking material within said glass housing to move toward said bowl area; further rotation of said body causes said auger to expel the smoking material from said upper open end portion of said glass housing.

2. The device of claim 1, further comprising a first opening disposed in said rear surface and spaced apart from said auger.

3. The device of claim 2, further comprising a first air passage way extending inward from said first opening in said rear surface of said rear body portion.

4. The device of claim 3, wherein said body further comprises a front body portion comprising a front surface; said first air passage way extends inward from said opening in said rear surface of said rear body portion to said front surface of said front body portion.

5. The device of claim 1, wherein said auger comprises a helical blade.

6. The device of claim 1, wherein said auger is press-fitted with said rear body portion of said body.

7. The device of claim 1, wherein said glass housing is a cylindrical tube.

8. The device of claim 1, further comprising a cap removably engaged with said upper open end portion of said housing.

9. The device of claim 8, wherein said cap is made from rubber.

10. The device of claim 4, further comprising a second opening disposed in said rear surface spaced apart from said auger.

11. The device of claim 5, further comprising a second air passage way extending inward from said second opening in said rear surface of said rear body portion.

12. The device of claim 6, wherein said first air passage way extends inward from said first opening in said rear surface of said rear body portion to said front surface of said front body portion.

13. The device of claim 7, wherein said second air passage way extends inward from said second opening in said rear surface of said rear body portion to said front surface of said front body portion.

14. The device of claim 8, wherein said body further comprises an intermediate body portion disposed outside of said glass housing.

15. The device of claim 9, wherein said intermediate body portion of said body abuts said lower open end portion of said glass housing.

16. The device of claim 1, further comprising a second rubber o-ring removably attached to said rear body portion.

17. The device of claim 10, wherein said front body portion, said intermediate body portion and said rear body portion are integrally made from a single piece of material.

18. The device of claim 1, wherein said lower open end portion of said glass housing is slidable on and off said first rubber o-ring mounted to said rear body portion of said body said glass housing to allow for filling of said glass housing with smoking material.

* * * * *